US007118000B2

(12) United States Patent
Shea

(10) Patent No.: US 7,118,000 B2
(45) Date of Patent: Oct. 10, 2006

(54) MERCHANDISING DISPLAY ASSEMBLY WITH AFFIXED AND ADJUSTABLE U-SHAPED BRACKET

(76) Inventor: Thomas M. Shea, 984 Livernois, Troy, MI (US) 48083

( * ) Notice: Subject to any disclaimer, the term of this patent is extended or adjusted under 35 U.S.C. 154(b) by 159 days.

(21) Appl. No.: 10/718,288

(22) Filed: Nov. 20, 2003

(65) Prior Publication Data

US 2005/0109719 A1 May 26, 2005

(51) Int. Cl.
*A47F 5/00* (2006.01)

(52) U.S. Cl. ..... 211/86.01

(58) Field of Classification Search ..... 211/86.01, 211/85.26, 110, 96; 248/214, 274.1; 40/124, 40/657.14, 657, 642.02
See application file for complete search history.

(56) References Cited

U.S. PATENT DOCUMENTS

| | | | | | |
|---|---|---|---|---|---|
| 417,102 | A | * | 12/1889 | Sims | 248/214 |
| 1,337,867 | A | * | 4/1920 | Whitaker | 248/214 |
| 2,642,250 | A | * | 6/1953 | Kasnowich | 248/229.1 |
| 3,221,429 | A | * | 12/1965 | Reuben et al. | 40/658 |
| 4,856,661 | A | * | 8/1989 | Guillen et al. | 211/100 |
| 5,282,368 | A | * | 2/1994 | Ordoukhanian | 62/372 |
| 5,957,422 | A | | 9/1999 | Shea | 248/220.31 |
| RE36,669 | E | * | 4/2000 | Zilincar, III | 211/86.01 |
| D459,626 | S | | 7/2002 | Shea | D6/567 |
| D464,510 | S | | 10/2002 | Shea | D6/469 |
| D464,837 | S | | 10/2002 | Shea | D6/567 |
| D464,838 | S | | 10/2002 | Shea | D6/567 |
| D465,371 | S | | 11/2002 | Shea | D6/567 |
| D465,372 | S | | 11/2002 | Shea | D6/567 |
| D466,352 | S | | 12/2002 | Shea | D6/567 |
| D467,114 | S | | 12/2002 | Shea | D6/566 |

* cited by examiner

*Primary Examiner*—Sarah Purol
(74) *Attorney, Agent, or Firm*—Gifford, Krass, Groh, Sprinkle, Anderson & Citkowski, P.C.

(57) ABSTRACT

A merchandising display assembly including an elongated display member exhibiting a first face and a second face. A plurality of merchandising support hangers extends from the first and second faces. A substantially "U" shaped bracket secures to an end of the display member and such that the display member is pivotally adjustable relative to the bracket. The bracket mounts to a location of an existing support and in order to support the display member in an elevated and elongate extending fashion.

12 Claims, 4 Drawing Sheets

MERCHANDISING DISPLAY ASSEMBLY WITH AFFIXED AND ADJUSTABLE U-SHAPED BRACKET

BACKGROUND OF THE INVENTION

1. Field of the Invention

The present invention relates generally to merchandising display assemblies for supporting volumes of merchandise. More specifically, the present invention discloses an elongated and reinforced display strip or member, pivotal relative to a lower disposed mounting bracket, which is capable of being affixed in any of a number of angularly disposed locations relative to an extending frame or rack support member.

2. Description of the Prior Art

Merchandising display support assemblies are well known in the art. The objective of such assemblies is to maintain or carry volumes of typically smaller sized and high volume merchandise, and which are usually associated with point of purchase or impulse buying items. Such support display assemblies are also intended to supplement the merchandise carrying capacity of existing gondola displays, and typically by being supported or suspended from the conventional displays.

A first example of the known art is set forth in U.S. Pat. No. 5,957,422, issued to Shea, and which teaches a reinforced strip display assembly capable of supporting high volumes of smaller impulse merchandise. In particular, an elongated strip display body having first and second planar and spaced apart faces is secured, such as by being suspended, from an elongated and extending support which is in turn secured to such as a pegboard support or single/double slot backplate support forming a part of an existing gondola display.

Additional examples of merchandising display structures, incorporating some form of strip display, include Design Pat. No. 465,371 and Design Pat. No. 466,352, issued to Shea. Yet additional merchandising display structures include Design Pat. No. 464,837, and Design Pat. No. 464,510 also issued to Shea.

SUMMARY OF THE PRESENT INVENTION

The present invention discloses a merchandise support assembly incorporating a pivotal and lower disposed mounting bracket, and which is capable of being affixed in any of a number of angularly disposed locations relative to an extending frame or rack support member. In particular, the pivotal display member is suitable for mounting to an existing gondola display or other merchandising support structure, and in order to provide additional product carrying capacity.

An elongated display member, such as a reinforced strip display, is provided and includes first and second planar faces to which are secured product supporting hangers. A substantially "U" shaped bracket is mounted to a location of an existing support, and such as which may further include a rectangular shaped and extending member.

A pair of thumb screws are provided and which extend through a selected surface of the bracket and in order to secure the same to the support. A pair of spaced apart plates extend from the bracket and define a pair of aligning and arcuate shaped channels.

An adjustable wing screw extends through the aligning tracks, as well as an associated end of an elongated support in order to pivotally and readjustably secure the support relative to the bracket. The support is received, in axially inserted fashion, within a channel defined in an interior of the reinforced strip display and to thereby facilitate the pivotal readjustability of the merchandise supporting display in an elevated and elongate extending fashion relative to the elevated support location.

BRIEF DESCRIPTION OF THE DRAWINGS

Reference will now be made to the attached drawings, when read in combination with the following detailed description, wherein like reference numerals refer to like parts throughout the several views, and in which.

DETAILED DESCRIPTION OF THE PREFERRED EMBODIMENTS

Figure 1:
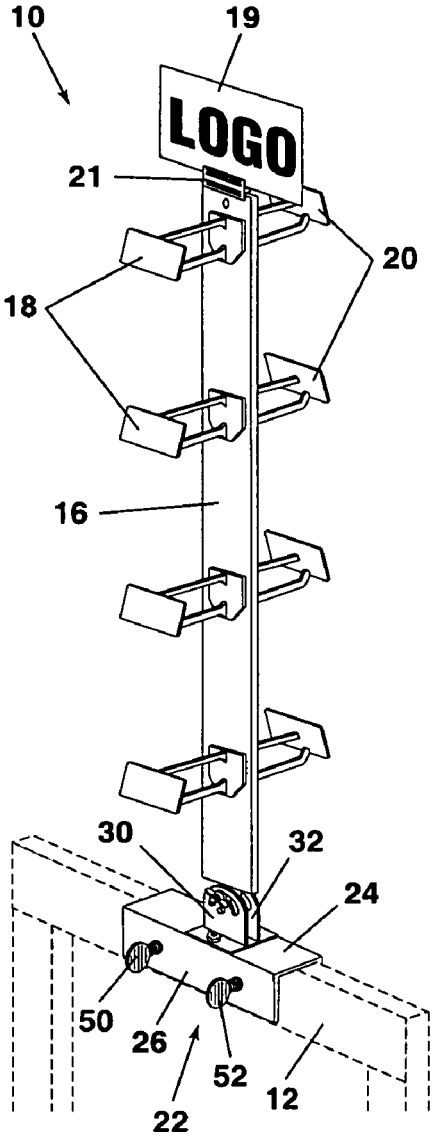
FIG. 1 is a perspective view of a merchandising display assembly with an affixed and adjustable bracket support according to the present invention.
Figure 2:
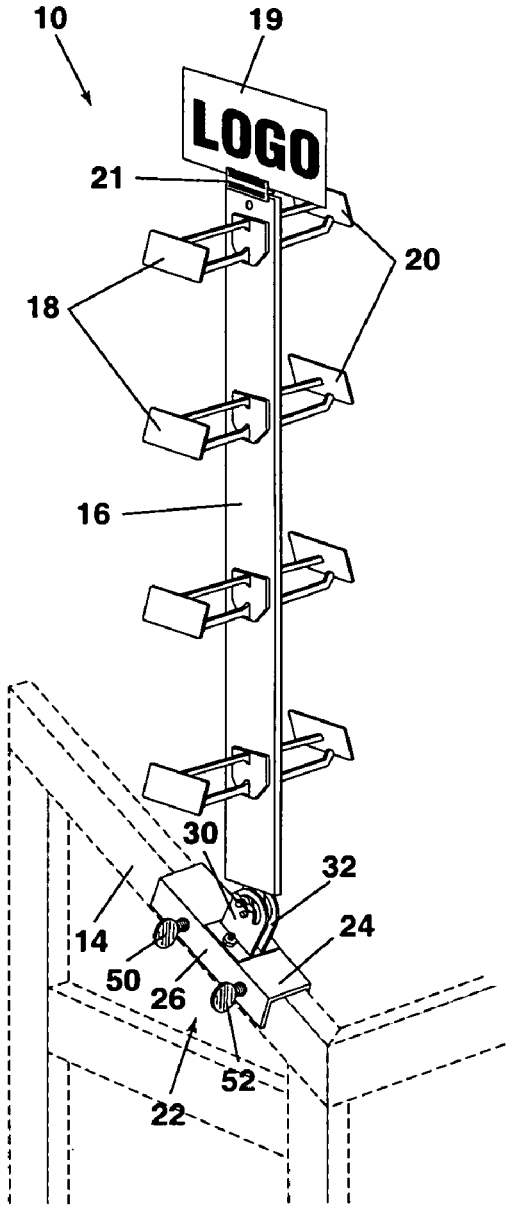
FIG. 2 is a substantially identical perspective view of the merchandising display assembly and illustrating the pivotally adjustable nature of the bracket relative to the elongated merchandise supporting display member.

Referring now to FIGS. 1 and 2, a merchandise support assembly is illustrated at 10 and which is capable of being affixed in any of a number of angularly disposed locations relative to an extending member 12 associated with a frame or cross member. In particular, the support assembly 10 is suitable for mounting to an existing gondola display or other merchandising support structure and in order to provide additional product carrying capacity beyond that which is associated with such conventional shelving or gondola supports.

For example, illustrated in phantom at 12 in FIG. 1 and at 14 in FIG. 2 are interconnecting and extending supports and such as which comprise a portion of an existing shelving or gondola display. It is also understood that a wide variety of mounting applications are made possible with the merchandise support assembly and beyond those nominally illustrated in the environmental examples of FIGS. 1 and 2.

Referring again to FIG. 1, the support assembly 10 includes the provision of an elongated and reinforced strip display 16, and such as which exhibits first and second oppositely extending faces. Pluralities of merchandise support hangers, such as are shown at 18 and 20, extend in opposite fashion from respective faces of the strip display 16 and which is usually further made possible by mounting apertures (not shown) formed in the faces and which facilitate mounting by associated seating portions of the hangers.

Also illustrated in FIGS. 1 and 2 is the provision of an advertising indicia, such as a sign 19, and which is mounted atop the strip display 16 by means of a clip 21 or other suitable fastening structure.

Although not shown, it is also understood that other suitable and elongate shaped display members, beyond that illustrated, may be incorporated into the display assembly and such as which may include four sided and reinforced plastic or metal arms or other elongate extending support members, capable of supporting volumes of merchandise without sacrificing the structural integrity of the display member.

Figure 3:
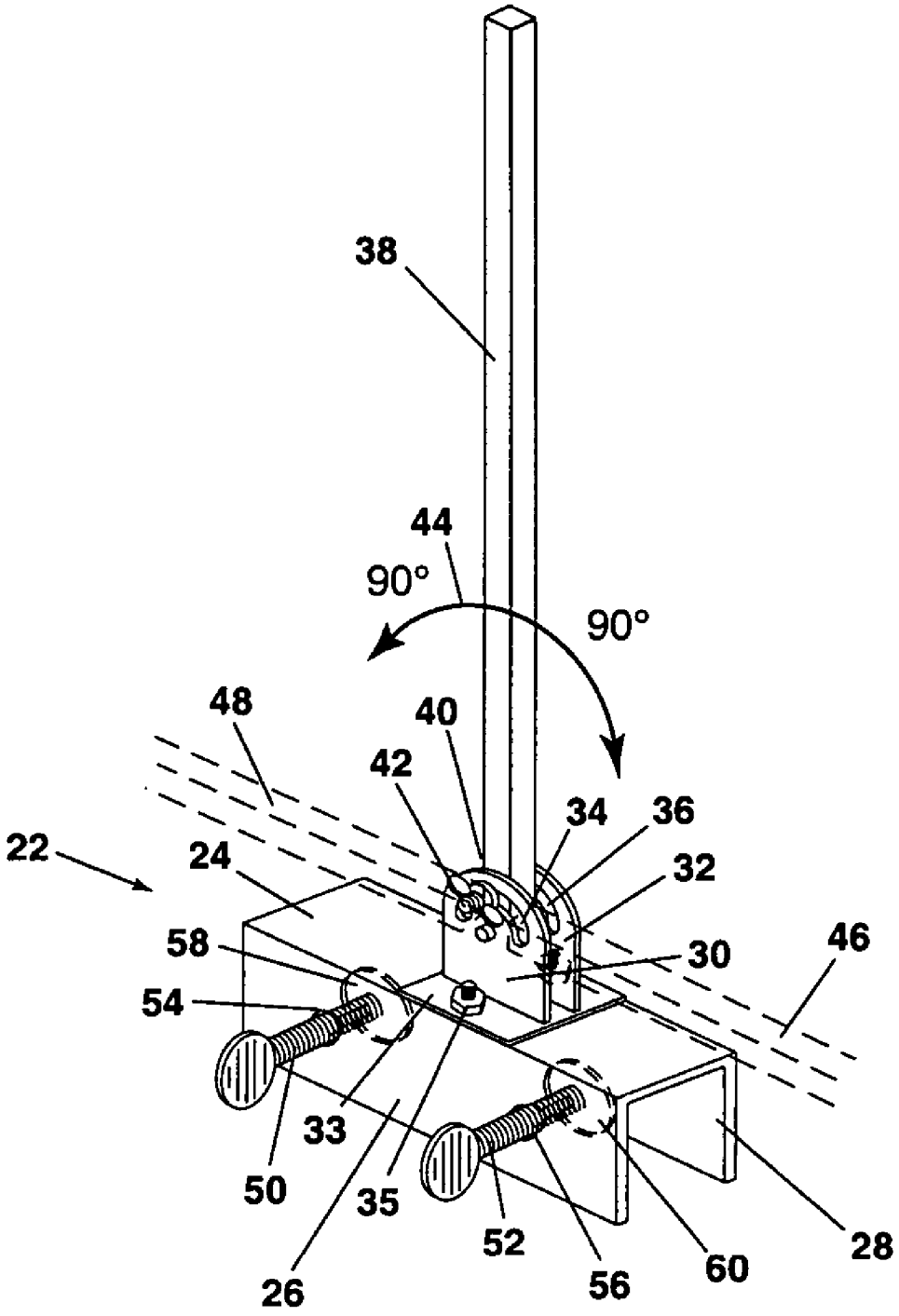
FIG. 3 is an enlarged perspective illustration of the pivotally adjustable bracket portion and extending support rod associated with the merchandise display assembly according to the present invention.

Referring also to FIG. 3, a substantially "U" shaped bracket is illustrated generally at 22 and which includes a middle face 24 and first and second interconnecting and angled faces 26 and 28. The configuration of the bracket 22 is such that its axially extending interior, defined by the interconnecting and extending faces 24, 26 and 28, is seatingly received over the existing supports 12 and 14 illustrated in FIGS. 1 and 2, respectively.

In a preferred embodiment, a pair of spaced apart plates are illustrated at 30 and 32 and which extend, in substantially perpendicular extending fashion, from the middle face 24 of the "U" shaped bracket. Each of the plates 30 and. 32 exhibits an arcuate shaped track, see at 34 and 36 in FIG. 3 for plates 30 and 32, respectively. A base plate 33 (see again FIG. 3), associated with the spaced apart plates 30 and 32, secures by screw and nut arrangements, see also at 35, in apertures (not shown) and in order to mount the spacer plates and arcuate shaped tracks to the selected middle face 24.

The spacing of the plates 30 and 32 and alignment of the arcuate tracks 34 and 36 permits the insertion of a selected end of an associated and elongated insert 38 (see again FIG. 3), such further including a reinforced steel rod or the like. Although not clearly illustrated in FIG. 3, it is understood that a crosswise/internally threaded aperture is formed through the selected end 40 of the insert 38, and such that, upon further alignment with the arcuate shaped tracks 34 and 36, an adjustable wing screw 42 is inserted.

As further is again illustrated in reference to FIGS. 1 and 2, the elongated extending length of the insert 38, again pivotally and repositionably associated with the bracket 22, is seated within an axially extending interior associated with the elongated strip display 16 and is held in place either through a friction fit or suitable fastener. The mounting variants of FIGS. 1 and 2 further illustrate the pivotally readjustable nature of the elongated strip display and in order to accommodate affixing to shelf support members of varying configuration.

As further shown in FIG. 3, the elongated and attached insert 38 is capable of being readjusted over an approximately 180° range along an axially extending plane relative to the bracket 22, as referenced by arcuate directional arrow 44 and substantially horizontally disposed phantom illustrations 46 and 48 of the elongated insert 38 in substantially maximum angled positions relative to the bracket. It is also envisioned that the configuration of the arcuate shaped tracks 34 and 36 in the associated plates 30 and 32 may be such as to either increase or decrease the angle of repositionable adjustment of the insert 38.

As is also illustrated in FIGS. 1–3, the primary means of securing the "U" shaped bracket to the associated shelf support member (such as again at 12 and 14) is provided through a pair of adjustable thumb screws 50 and 52 which are threadably engaged through interiorly threaded apertures 54 and 56 (see as best shown in FIG. 3) formed at spaced locations along the extending side 26. Disk-shaped ends 58 and 60 (see as also shown in phantom in FIG. 3) are associated with inner projecting ends of the thumb screws 50 and 52 and such that, upon tightening of the screws, are abuttingly engaged against mating surfaces of the shelf supports 12 and 14. In this manner, both the axial location of the "U" shaped bracket, as well as the angular position of the elongated strip 16, can be easily and quickly adjusted without the need of tools.

Figure 4:
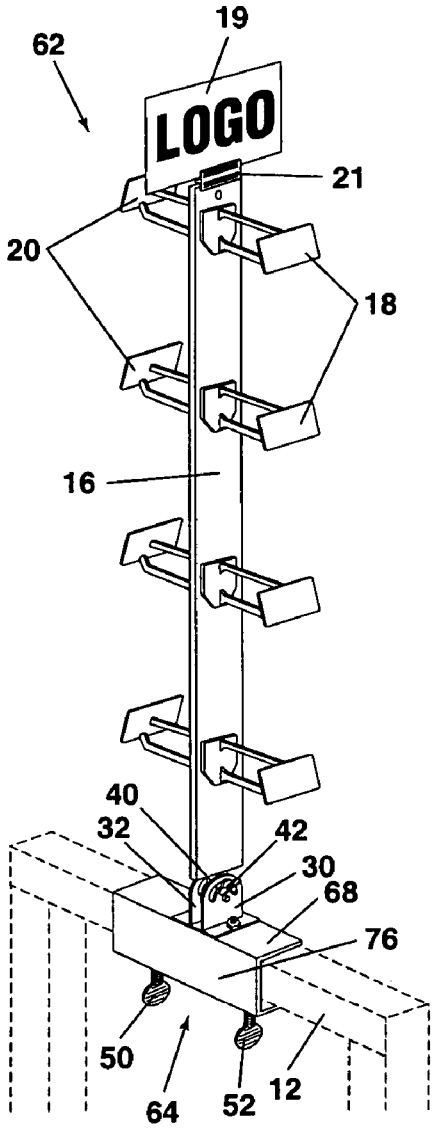
FIG. 4 is a succeeding perspective illustration of a further variant of merchandising display assembly and illustrating a differently configured adjustable bracket portion.
Figure 5:
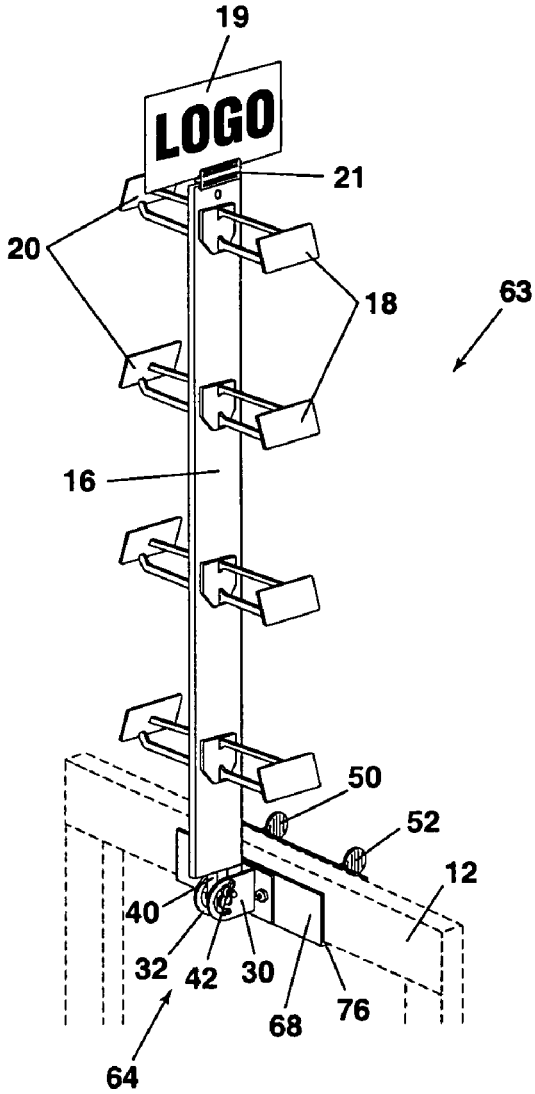
FIG. 5 is a further succeeding perspective illustration of merchandising display assembly and illustrating a differently configured bracket portion.
Figure 6:
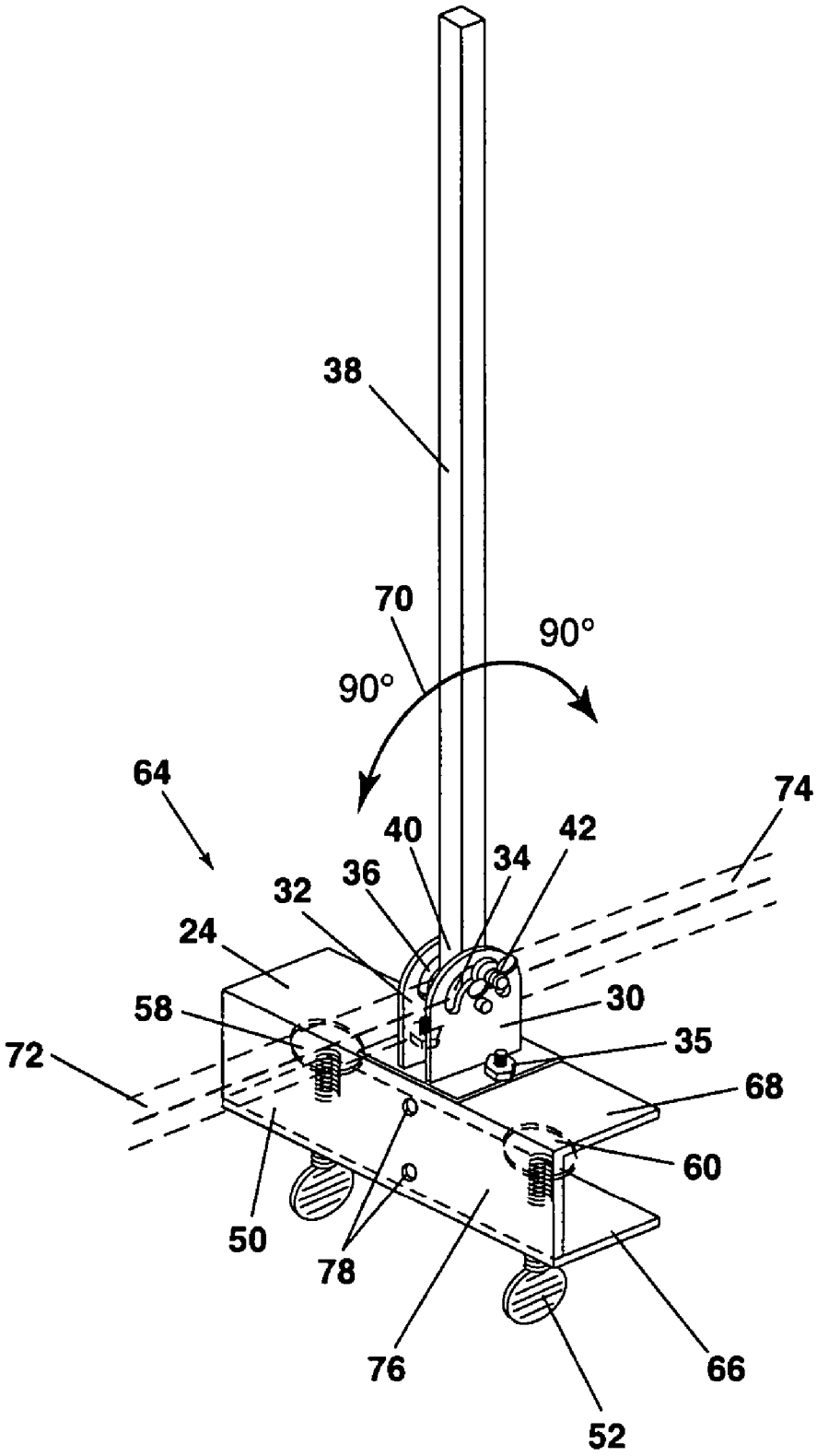
FIG. 6 is an illustration similar to that shown in FIG. 3 and showing an alternatively configured bracket portion and extending support rod associated with the merchandising display assembly according to the present invention.

Referring further to FIGS. 4–6, additional examples of the configuration and adjustability of the merchandise display assembly are shown. In particular, FIGS. 4 and 5 illustrate variations 62 and 63 of the merchandise display assembly secured to the existing shelf support 12 and such as through a variation 64 of the "U" shaped bracket (see also FIG. 6) and by which the thumb screws 50 and 52 are formed through a first selected and angled face 66 and the pair of angled plates 30 and 32 are secured to a second selected and angled face 68.

In this arrangement, the elongated and attached insert 38 (see again arcuate tracks 34 and 36 and attached wing screw 42) is mounted to the "U"shaped bracket 64 such that it is pivoted along a crosswise extending plane relative to the bracket and which is further referenced by arcuate arrow 70 and maximum/horizontal adjusted positions 72 and 74. An interconnecting planar face 76 in FIG. 6 illustrates mounting holes 78, and which facilitate the rotating and affixing of the base plate 33 and spaced apart plates 32 and 34 (with associated fasteners 35) between the axially coplanar arrangement shown in FIGS. 1–3 and the crosswise coplanar arrangement illustrated in FIGS. 4–6.

In this fashion the merchandising display assembly is capable of being quickly clamped to the top, sides or bottom of a variety of support locations, such as including tables, rack supports or any other suitable surface which will permit the use of a clamp. The further use of the elongated and reinforced insert 38 provides axial rigidity and strength to the elongated strip display 16 or any other product supporting display capable of being supported upon the insert and associated bracket. It is also contemplated that a variety of peg hooks and other product supporting hangers can be used with the merchandising display surface and the display further provided with custom lengths and colors to enhance product advertisement.

Having described my invention, other and additional preferred embodiments will become apparent to those skilled in the art to which it pertains, and without deviating from the scope of the appended claims.

I claim:

1. A merchandising display assembly, comprising:

an elongated display member having at least a first face and a second face;

a plurality of merchandising support hangers extending from at least one of said first and second faces;

a bracket secured to a lower end of said display member and such that said display member is pivotally adjustable relative to said bracket, said bracket mounting to a location of an existing support and in order to support the display member in an elevated and elongate extending fashion; and an arcuate shaped track defined in an extending surface of said bracket interconnecting said display member, said track defining a range of pivotal adjustment of said upwardly extending display member relative to said bracket.

2. The merchandising display assembly as described in claim 1, further comprising a substantially "U" shaped bracket, at least one adjustable screw communicating with a surface of said bracket and contacting the existing support.

3. The merchandising display assembly as described in claim 2, further comprising a pair of adjustable thumb screws associated with said bracket.

4. The merchandising display assembly as described in claim 1, said elongated and merchandise supporting display assembly further comprising a strip display, an elongate insert being pivotally associated with and extending from said arcuate shaped track and axially seating said strip display.

5. The merchandising display assembly as described in claim 4, further comprising first and second spaced apart plates exhibiting aligning tracks, an adjustable wing screw extending through said aligning tracks and an associated end of said elongate insert.

6. The merchandising display assembly as described in claim 1, said elongated display member exhibiting a specified shape and size and being adjustable over at least a 180° range of pivotal adjustment.

7. The merchandising display assembly as described in claim 6, further comprising said elongated display pivoting along an axially extending plane relative said bracket.

8. The merchandising display assembly as described in claim 6, further comprising said elongated display pivoting along a crosswise extending plane relative said bracket.

9. The merchandising display assembly as described in claim 1, said elongated display member exhibiting a specified shape and size, an advertising indicia securing to a specified location of said display member.

10. A merchandising display assembly, comprising:

an elongated and reinforced strip display exhibiting first and second oppositely facing surfaces;

a plurality of merchandise support hangers extending from said first and second faces;

a substantially "U" shaped bracket mounting to a location of an existing support, an elongated insert pivotally secured to said bracket and seatingly engaged with an axially extending interior defined within said strip display and such that said strip display extends in upwardly extending fashion from said bracket; and first and second spaced apart plates extending from a surface of said bracket, said plates exhibiting aligning tracks, an adjustable wing screw extending through said aligning tracks and an associated end of said elongate insert;

said strip display being supported in an elevated elongate extending and pivotally adjustable fashion relative the existing support.

11. The merchandising display assembly as described in claim 10, further comprising a pair of adjustable thumb screws associated with said bracket.

12. The merchandising display assembly as described in claim 10, said elongated display member exhibiting a specified shape and size and being adjustable over at least a 180° range of pivotal adjustment.

* * * * *